United States Patent [19]

van Berkum

[11] Patent Number: 4,747,355

[45] Date of Patent: May 31, 1988

[54] COMBUSTION APPARATUS AND METHOD OF GENERATING GAS

[76] Inventor: Robert A. van Berkum, Box 351, Chagrin Falls, Ohio 44022

[21] Appl. No.: 829,195

[22] Filed: Feb. 14, 1986

[51] Int. Cl.[4] ..... F23G 5/12

[52] U.S. Cl. ..... 110/229; 110/118; 110/212; 110/214; 110/257; 110/281; 110/293

[58] Field of Search ..... 110/101 C, 102, 117–118, 110/165 R, 170, 185, 203–204, 210–214, 229–230, 233–235, 255–259, 267–268, 278, 281–282, 293, 327–328, 346, 344; 431/5

[56] References Cited

U.S. PATENT DOCUMENTS

| | | | |
|---|---|---|---|
| 1,991,828 | 2/1935 | Tynan | 110/118 |
| 2,381,200 | 8/1945 | Blake | 110/165 R |
| 2,506,782 | 5/1950 | Fallon | 110/165 R |
| 3,631,823 | 1/1972 | Scogin | 110/213 |
| 3,777,676 | 12/1973 | Lagen | 110/255 X |
| 4,103,627 | 8/1978 | Mainka | 110/281 |
| 4,109,590 | 8/1978 | Mansfield | 110/235 |
| 4,239,029 | 12/1980 | Martin et al. | 110/268 X |
| 4,300,460 | 11/1981 | Lamb et al. | 110/346 |
| 4,385,567 | 5/1983 | Voss | 110/257 X |
| 4,528,917 | 7/1985 | Jacobs | 110/267 X |

FOREIGN PATENT DOCUMENTS

| | | | |
|---|---|---|---|
| 150725 | 9/1982 | Japan | 110/203 |
| 2005822 | 4/1979 | United Kingdom | 110/203 |

*Primary Examiner*—Steven E. Warner

*Attorney, Agent, or Firm*—Fay, Sharpe, Beall, Fagan, Minnich & McKee

[57] ABSTRACT

A first stage, sub-stoichiometric reaction chamber (12) reacts a carbon-based fuel with an oxygen-carrying gas to produce a combustible gas, heat, and residual ash. A rectangular grate (B) supports a fuel pile (34) in the reaction chamber. A fuel supply (20) continuously supplies the carbon-based fuel from overhead in sufficient quantity to maintain the desired pile configuration with minimum particle entrainment in the generated gas. A fabric chute (36) may be provided to further limit particulate entrainment in the generated combustible gas. A temperature sensor (78) monitors temperature at the grate or another preselected reaction condition. When the preselected condition is sensed, the grates are reciprocated to step residual ash to an ash removal conveyor (74). Nozzles (82) combust a portion of the generated gas to inhibit condensation of vaporized constituents. A second stage, combustion chamber (C) completely combusts the generated gas to derive useful work therefrom.

16 Claims, 5 Drawing Sheets

A
B
C
10
12
20
22
24
26
30
32
34
40
42
56
60
62
64
76
78
80
82
84
86
88
94
96
2
3

COMBUSTION APPARATUS AND METHOD OF GENERATING GAS

BACKGROUND OF THE INVENTION

This invention pertains to the art of combustion apparatus and, more particularly, to a gas generator. The invention is particularly applicable to wood gas generation and will be described with particular reference thereto. However, it will be appreciated that the invention has broader applications and may be advantageously employed in other carbon-based fuel environments and applications.

In the past, two stage combustion processes have been developed for converting high moisture content carbon-based fuels into energy without undue pollution of the atmosphere. Typically, the first stage converts the fuel into two components, a combustible gas and residual ash. The second stage combusts the gas to release heat energy. The generated gas burns as cleanly as natural gas, so that expensive clean-up equipment is unnecessary. In fact, the combustion of the gas requires less air than conventional single stage combustion processes for similar fuels. Therefore, the combustion efficiency of the two stage process is higher.

Generally, a gas generator converts a solid carbon-based fuel into a combustible gas through continuous reaction with an oxygen-carrying gas. The reaction may be broken down into a sequence of reaction zones defined along the direction of gas flow such as an ash zone followed by an oxidation zone, a reduction zone, devolatilization and preheating zones. When wood or bark is used as the fuel, usually as a by-product of a saw mill or papermaking industry, the wood waste fuel is used to provide energy for process. The moisture content of wood and bark is generally high, such that the heat required to heat the fuel and evaporate the moisture is also quite high. The parameters must be closely controlled in order to assure combustion without injecting an excess amount of air into the reaction chamber.

By way of example, U.S. Pat. Nos. 4,300,460 issued Nov. 1981 to Frank Lamb, et al.; 4,384,534 issued May 1983 to Frank Lamb, et al.; and 4,388,876 issued Jun. 1983 to John Burton illustrate the various apparatus utilized by industry. The combustion apparatus illustrated in the enumerated patents, as well as in other prior art units, are not designed to produce gas as an output. Rather, these units burn the gas immediately in a combustion chamber that is integrated closely with the first stage gas generation equipment. These two stage units, when considered as a whole, produce energy in the form of hot products of combustion. Additionally, the above-noted design configurations are limited to cylindrical chambers which, in turn, limits the size and efficiency of the units to approximately 60,000 lb. of steam generation per hour. Another drawback is encountered with systems similar to U.S. Pat. No. 4,384,534 which has a radial rabble arm for ash removal. The radius length of the rabble arm is limited by both mechanical and effective ash removal constraints which again limit the size of the units.

It has, therefore, been deemed desirable to design a wood gas generator which overcomes the above-noted deficiences and others. By way of example, a system having a reduced capital cost that reduces the amount of power consumption, as well as eliminating environmental clean-up equipment such as scrubbers or the like, would be greatly desired. In addition, separation of a generated clean gas for direct combustion within boilers, kilns, or similar heat exchange equipment and for direct powering of gas turbines and the like is desirable. The subject invention is deemed to meet these needs and others in an economical manner.

SUMMARY OF THE INVENTION

The present invention contemplates a new and improved combustion apparatus which incorporates a gas generator having an internal reaction chamber disposed in a housing. The housing includes fuel supply means for supplying a carbon-based fuel to the reaction chamber. The fuel is formed into a pile of generally constant configuration and means for supporting the fuel pile are disposed adjacent the bottom of the reaction chamber. The supporting means cooperates with a gas inlet for supplying an oxygen-carrying gas for chemical reaction with the fuel pile. Ash removal means for removing by-products resulting from the chemical reaction from the chamber are provided. Additionally, a gas outlet transports the generated gases from the first stage housing.

In accordance with a more limited aspect of the invention, means for heating the generated gas inhibit condensation of vapors therefrom.

In accordance with another more limited aspect of the invention, the support means includes an elongated grate that has a tiered surface of alternating fixed and movable rows. The movable rows are adapted for reciprocating movement relative to the fixed rows for removing ash by-products in a stepwise fashion.

In accordance with yet another more limited aspect of the invention, the bottom grate surfaces are serrated forming passages for the oxygen-carrying gas. The grate surface includes a serpentine leading edge for increasing the contact area between the fuel and oxygen-carrying gas.

In accordance with another aspect of the invention, means for sensing the reaction are operatively connected with means for moving the alternating movable rows.

In accordance with a further aspect of the invention, the fuel supply means includes means for limiting entrainment of particulate matter into the generated gas. In accordance with another aspect of the invention, a recirculating means recirculates a portion of the generated gas from the gas outlet to an under portion of the grate.

In accordance with a still further aspect of the invention a second stage combustion device operatively connected with the gas outlet for combusting the generated gas.

In accordance with another aspect of the invention, a method of generating combustible gases from carbon-based fuels is provided. The method includes the steps of continuously supplying a carbon-based fuel, adding an oxygen-carrying gas to the chamber for oxidizing the fuel, periodically removing by-product materials from the chamber, collecting the generated gases above the fuel pile, and heating the generated gases to a preselected temperature to prevent condensing out of vapor constituents.

A principal advantage of the present invention is that a rectangular, rather than circular, reaction chamber shape permits higher capacity units to be built by simply extending unit length, or by placing two or more grate assemblies side by side beneath a common reaction chamber.

Another major advantage of the present invention is the generation of a clean gas that can be transported to other heat exchange equipment and can be compressed for direct powering of a turbine.

Further advantages of the invention reside in low capital cost, low operating power and energy consumption, reduced maintenanc, and the elimination of sophisticated pollution control equipment.

Another advantage of the present invention is the maintenance of constituents in a superheated state and suspended in the generated gas. This avoids problems in downstream equipment attributable to the condensation of water and tar-like substances.

Yet another advantage resides in the continuous removal of ash from the grate surface. Excessive ash inhibits the conversion process.

Still further advantages of the present invention will become apparent to other upon reading and understanding the following detailed description of the preferred embodiment.

BRIEF DESCRIPTION OF THE DRAWINGS

The invention may take form in various parts and arrangements of parts or in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
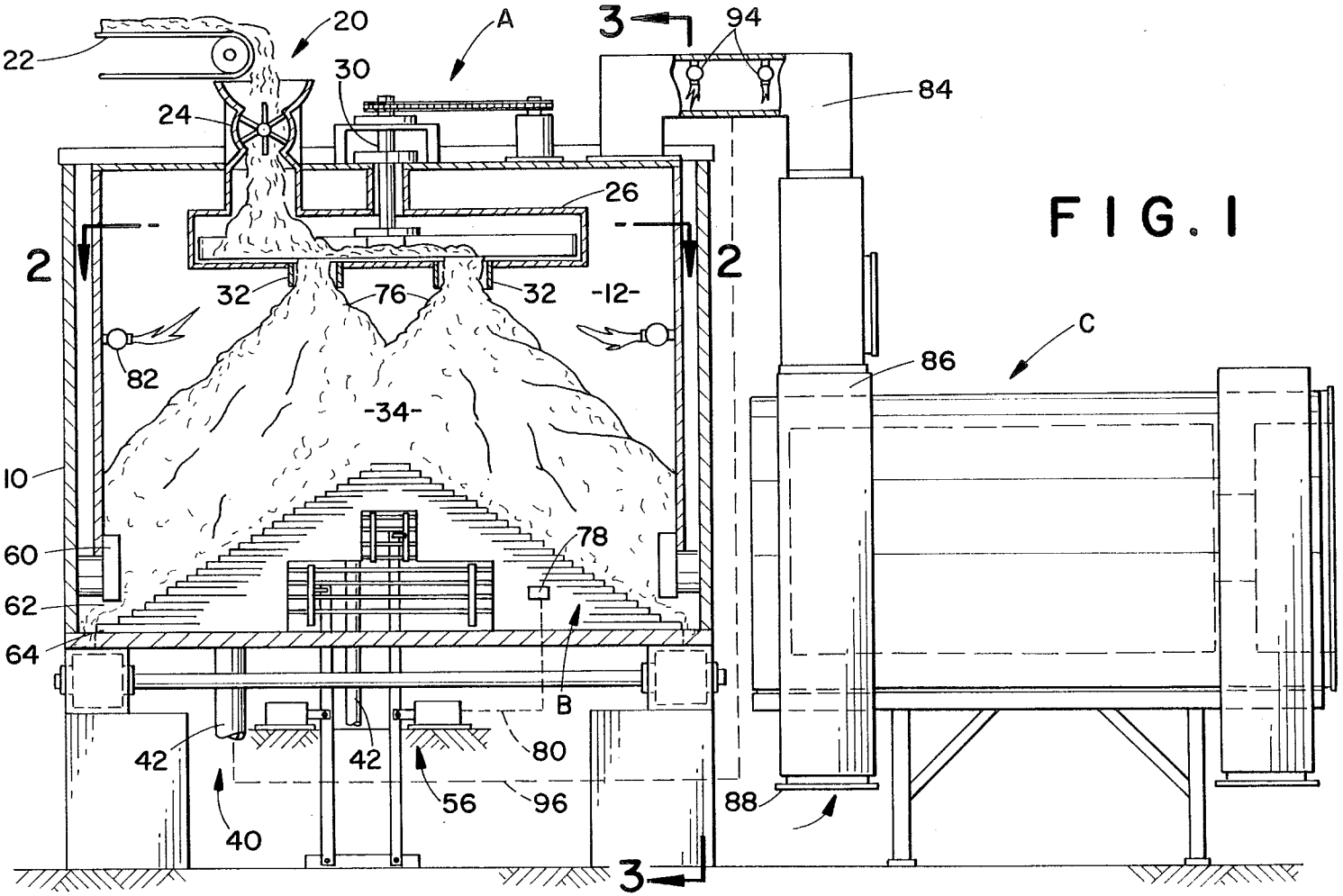
FIG. 1 is an elevational view in partial section of a combustion apparatus in accordance with the present invention.

With reference to FIG. 1, a first stage gas generator A converts pieces of a carbon-based fuel into a combustible gas and a residual ash. The residual ash and fuel are supported on fuel pile supporting means or an oxygen-carrying gas passes upward therethrough partially oxidizing the fuel. The generated gases percolate up through the fuel and are heated to a preselected temperature. The temperature is selected to superheat the volatile constituents and prevent condensation thereof. The generated gas is directed to a remote combustion chamber C such as in a boiler, kiln, or gas turbine.

Specifically, the gas generator A includes a housing 10 which defines an internal reaction chamber 12 therein. A fuel supply means 20 supplies the carbon-based fuel pieces, such as wood chips, bark or the like, to the reaction chamber. The fuel is transported by a conveyor 22 to a sealing feeder 24 mounted with the housing 10. Preferably, a rotary sealing feeder is provided, but other one-way feeders are contemplated. A spreader box 26 controls the feed rate of the fuel received from the sealing feeder into With particular reference to FIG. 2, the spreader box 26 has a distribution means such as a plurality of radial arms 28. The arms are rotatably driven in conventional fashion by a motorized drive shaft 30. Plural fuel ports 32 in the base of the spreader box 26 form fuel inlets to the reaction chamber 12. It will be understood that other continuous feed level control devices may be used within the spirit of the present invention. Excess fuel is provided at the point of fuel entry into the spreader box. In this manner, sufficient fuel is provided to maintain the fuel ports 32 completely full at all times as the spreader arms 28 rotate and distribute the fuel in the spreader box. This arrangement results in a solid column of fuel extending from inside the fuel ports down to the main fuel pile. The resulting smooth, continuous flow minimizes the possibility of particulate entrainment in the exiting gases. Although an excess of fuel is maintained within the spreader box, the level of fuel within the spreader box is controlled by means of a level control device (not shown) which regulates the rate of fuel fed into the spreader box.

Figure 2:
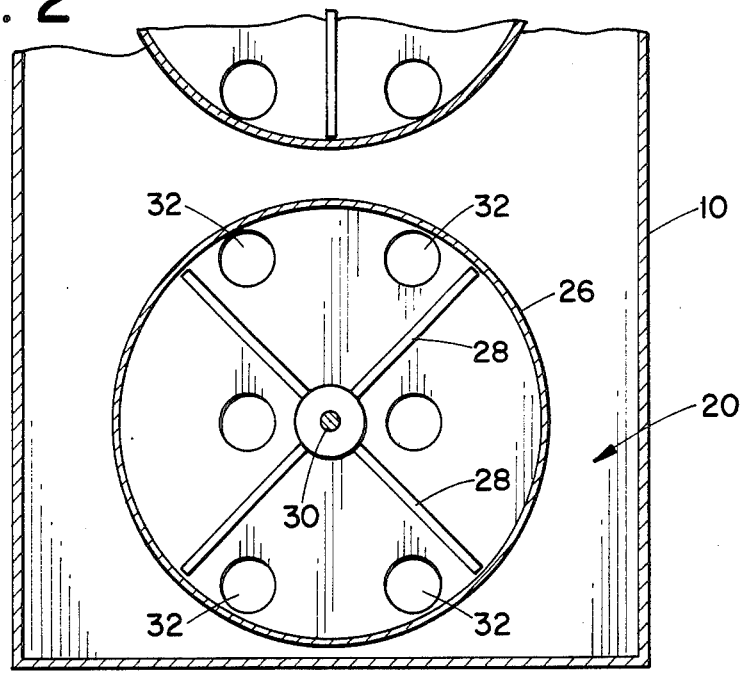
FIG. 2 is a sectional view through section 2—2 of FIG. 1.
Figure 3:
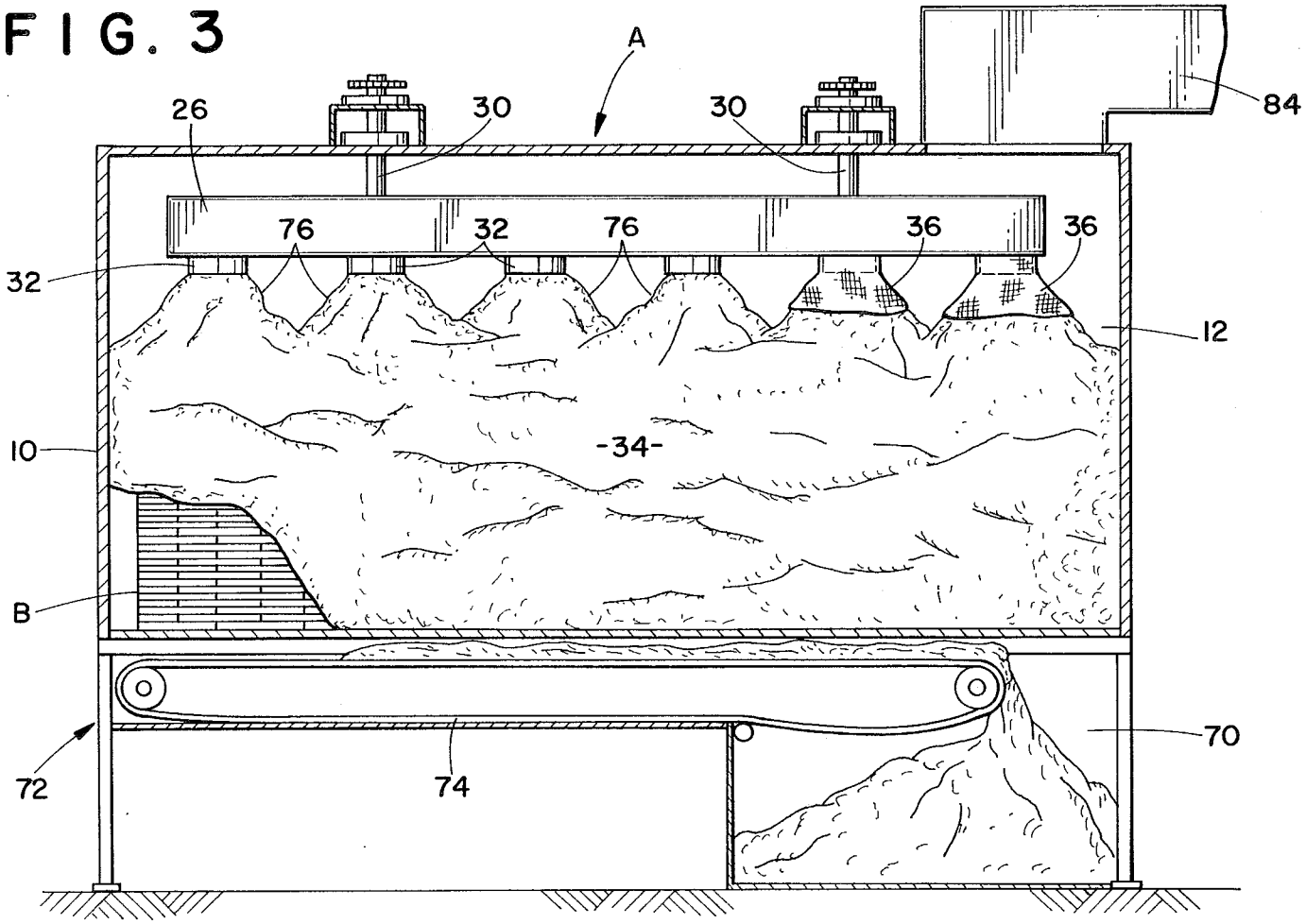
FIG. 3 is a side sectional view of the gas generator of FIG. 1.

The plural fuel ports are arranged in a rectangular fashion, as seen in FIGS. 2 and 3, to form a fuel pile 34 in the reaction chamber. The rectangular geometry enables a larger fuel pile to be formed than was previously possible in cylindrical combustion chambers. Prior arrangements were designed to form a generally conical fuel pile which was limited in its capacity by the fuel pile thickness. The fuel ports 32 may each include a means for further preventing entrainment of particulate matter into generated gases rising from the fuel pile, such as filter means or fabric chute 36 formed of a heat resistant material which entrains particulate matter and yet allows gases to pass therethrough. This material allows continuous feeding of fuel to the reaction chamber without suspension of particulate matter in the exiting gases.

Once the fuel pile has been properly formed, the bottom of the pile is ignited. Gas carries a source of oxygen from below to maintain and control the combustion. The gas may be air or any other gas containing sufficient oxygen for a sub-stoichiometric reaction in accordance with the teachings hereinbelow. As the fuel is converted into combustible gases and an ash residue, heat is released. The oxygen carrying gases and heat flow upward through the fuel pile causing the release of volatiles from the fuel as well as the vaporization of moisture contained in the fuel.

The continuous supply of fuel to the pile maintains a generally constant fuel pile configuration which, in turn, prevents formation of blow holes. Blow holes appear to disturb the gas generation resulting in combustion of volatiles in the region around the blow holes.

Referring again to FIG. 1, an oxygen supply means 40 supplies an oxygen-carrying gas at a controlled rate from an exterior source to the base of the fuel pile through a grate assembly B. Oxygen-carrying gas conduits 42 convey the gas from a variable rate oxygen supply means such as an adjustable damper or variable speed air compressor (not shown), into the reaction chamber. As described above, the oxygen in the combustion gas reacts chemically with the carbon in the fuel pile to form combustible gases along with a residue ash. The ash settles along the surface of the grate assembly B, as will be explained further hereinafter. The heat and combustible gases move upward through the fuel pile releasing the volatiles held in the fuel, heating the fuel pile, and vaporizing the mositure contained therein. The even distribution of the fuel and provision of an underfire air supply maintains the temperature in the gas generator chamber above the pile at a reasonably low level. As a result, it becomes practical to feed the carbon-based fuel pieces from overhead. Additionally, the surface area of the fuel pile minimizes the exit velocity of the generated gas and avoids particulate entrainment.

The residual ash forms a layer on the grate surface that is periodically removed therefrom while new carbon-based fuel is supplied from above. In this manner, a relatively constant reaction is maintained in the chamber. A controlled supply of oxygen-carrying gas provides continued steady reaction with the fuel resulting in generation of heat, combustible gas, and residue ash at generally constant rates.

Figure 4:
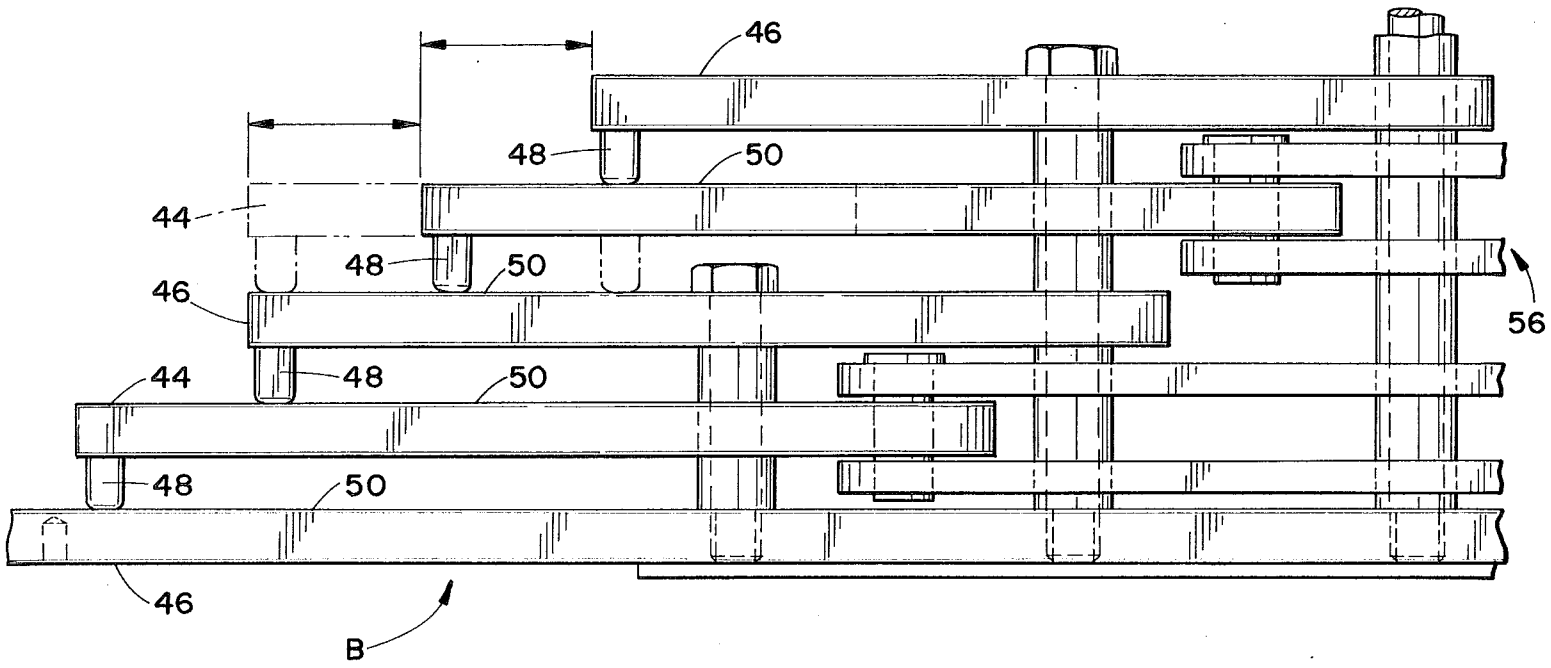
FIG. 4 is an enlarged view of the grate structure in accordance with the present invention.

With particular reference to FIG. 4, the grate assembly B includes alternating stacked moving portions 44 and fixed portions 46 arranged in a tiered fashion. As the residual ash settles on the non-porous, horizontal grate surface, the movable grates are periodically extended and retracted, or retracted and extended to move the ash down the tier of grates. Upon retraction, material resting on the horizontal or top surface of the retracting movable grate is pushed forward by the leading edge of the stationary grate thereabove. As the movable grate is fully retracted underneath the next higher grate, the entire top surface is subjected to the scraping action of the fixed grate above it. The material formerly resting on the top surface of the retracting grate is deposited on the fixed grate surface below. Upon extension of the same movable grate, its leading edge pushes the material resting on the top surface of the fixed grate below. The material already resting on the lower fixed grate top surface and the material received from the retracted grate top surface are pushed off onto the next lower surface. The next lower surface is, again, a moving grate. Retracting and extending the next lower moving grate repeats the above-described process. In this manner, it is seen that all grate surfaces can be subjected to positive clearing action, with all of the material being "walked down" in stepwise fashion to the bottom periphery of the grate assembly.

Figure 6:
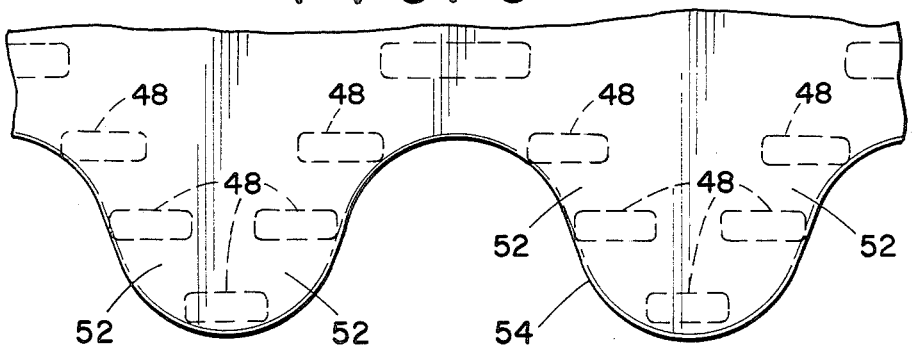
FIG. 6 is a top view of the grate structure of FIG. 4.
Figure 5:
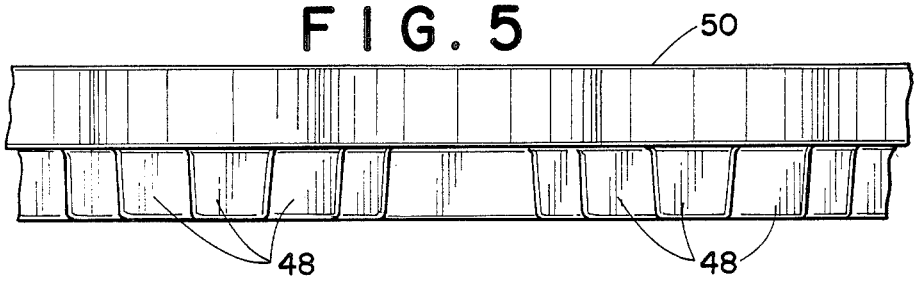
FIG. 5 is a side view of a portion of the FIG. 4 grate structure.

The scraping action is accomplished by serrations on the rows, particularly as set of teeth 48 formed in the bottom of each grate, as particularly seen in FIGS. 5 and 6. The teeth rake the grate surface 50 below and provide passages 52 therebetween to accommodate the oxygen-carrying gas. The oxygen-carrying gas enters from beneath the grate assembly, around the teeth 48, and out the front edge of each grate to the bottom of the fuel pile 34. The teeth are arranged such that the reciprocating action of the moving grates prevents these passages from becoming blocked. Additionally, the even distribution of the carbon fuel and the underfire oxygen-carrying gas avoids formation of blow-holes in the piles.

Many prior art devices use pin holes in the upper grate surface 50 for distribution of combustion air. Ash and fuel may disadvantageously enter the oxygen supply means 40 through these pin holes. Therefore, in an effort to eliminate this problem, grate surface 50 is preferably a continuous solid surface without any pin holes.

The leading edges of the grate portions are constructed in a scalloped or serpentine configuration 54 as seen in FIG. 6. The scalloped pattern maximizes the contact area between the fuel pile and the oxygen-carrying gas emitted through the passages 52. The scalloped pattern, as will be understood by one skilled in the art, maximizes the oxidation area. The movable grate portions can be reciprocally retracted and extended by any of a variety of conventional actuating means 56. The means for moving the alternate grate rows, i.e., the means for reciprocating the grate sections, can be hydraulic or pneumatic cylinder devices, or, alternatively, mechanical crank arm linkages. Preferably, the reciprocating actuating mechanism is accessible from the exterior of the gas generator A and has a seal bushing maintaining a sealed relationship between the external environment and the reaction chamber.

The residual ash is conveyed in a stepped fashion to the outer periphery of the grate assembly B. Ash gates 60 (FIG. 1) are constructed of a heat-resistant material and provided along the lower exterior of the reaction chamber to contain the fuel pile. The ash gates define a gap 62 through which the ashes are pushed by the reciprocating action of the grate portions. The ash gates are adjustable in their height relative to a peripheral grate area portion 64 to adjust the exit gap 62 such that only the lower layer of ash is discharged and the uppe laye of hot coals is retained in the combustion chamber 12. In this manner, the ash removal gap is sealed by the ashes, coals, and fuel that fall by gravity against the gates and the combustion chamber side walls.

Referring again the FIG. 3, the residual ash passing through the gap 62 is transported to a collecting area or ash pit 70 by a by-product removal means 72. In the preferred embodiment, the by-product removal means 72 includes an endless belt mechanism 74 which receives the ash from the periphery of the fuel pile and transports it to the collecting area 70. The ashes may then be removed by conventional ash removal means without breaking the interface seal between the reaction chamber and the external environment, as will be understood by one skilled in the art.

As the fuel at the bottom of the pile is converted to combustible gases and ash, the fuel in the pile will travel in a downward direction. The natural angle of repose of the fuel will result in plural cones 76 being formed at the top of the fuel pile, each cone leading in an unbroken column from the carbon fuel ports 32 to the fuel pile 34.

The action of the slowly rotating spreader arms 28 assures that each fuel port has more than enough fuel to keep it continuously filled. The unbroken fuel cone continually replenishes the fuel pile as the fuel is consumed. This provides means for feeding fuel to the reaction chamber, as required, to maintain constant combustion conditions without causing suspension of particulate matter in the generated gas.

A sensing means 78 (FIG. 1) disposed in the grate assembly B monitors at least one preselected reaction condition of the chemical reaction occuring in the reaction chamber 12. The reaction may be monitored by measuring the grate temperature, the residual ash temperature, or the like. Alternatively, a time measurement may be taken to initiate or control movement of the grate portions 44. In response to the grate or ash dropping to a preselected temperature, the actuating means 56 is operated to remove part of the lower ash layer. An operative connection 80 is represented as a dotted line extending from the sensing means to the actuating means 56. The connection 80 is exemplary of any conventional communication between the sensing means and actuating means. Because removal of the residual ash is closely monitored and a continuous supply of carbon fuel is provided from overhead, a generally constant configuration of the fuel pile is maintained.

As the combustible gas rises from the fuel pile, the generated gas collects in the reaction chamber 12. The gas produced in the gas generator A may contain substances such as pitch, water, tar, or the like, which, if allowed to condense out, may form deposits or, in other ways, impede equipment operation. A heating means causes a controlled amount of combustion in the upper part of the reaction chamber 12 to maintain the gas above the dew point of these vaporized substances and to inhibit the condensation of vapors therefrom. In the preferred embodiment, a low velocity jet of air is injected into the reaction chamber 12 by a burner means or nozzles 82 to combust a small, controlled portion of the released wood gases. The burners 82 are arranged in a suitable pattern for uniform heating of the gas. The amount of heat introduced into the reaction chamber is adjusted by controlling the flow rate of the combustion air through the nozzles 82. Complete combustion of the generated gases is prevented by regulating the combustion air to a low flow rate. The heated generated gases exit the first stage gas generator A through an outlet 84 (FIG. 3). The generated combustible gases are maintained at a sufficiently high temperature that no condensation of the vaporized constituents takes place.

Figure 7:
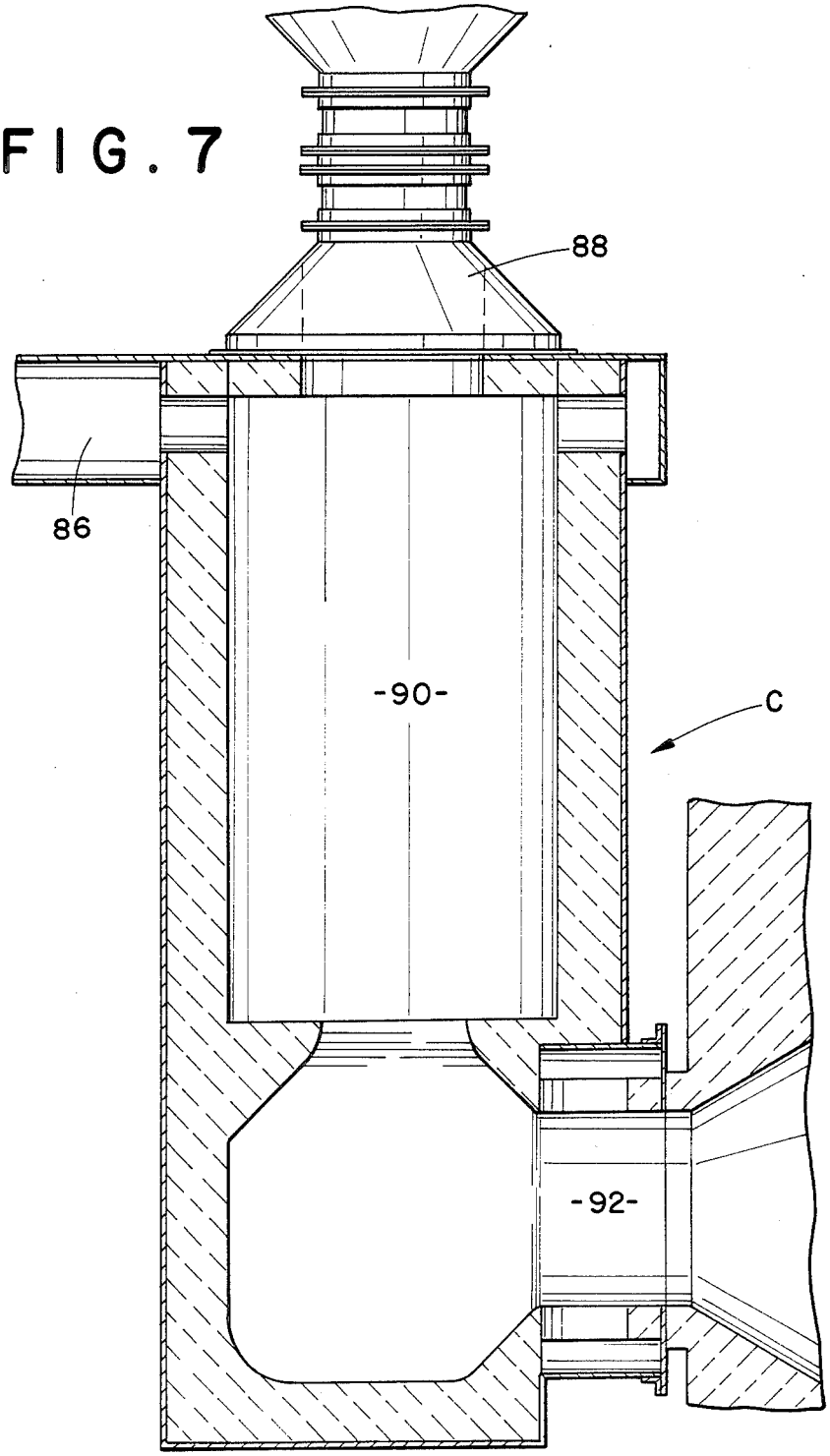
FIG. 7 is a side sectional view of an exemplary second stage combustion chamber.

With continuing reference to FIG. 1 and further reference to FIG. 7, the generated gas enters the downstream equipment C, such as a high temperature burner, at inlet 86. A small amount of combustion air or oxygen from air inlet 88 is mixed in a cyclone burner chamber 90 with this gas and ignited to raise the temperature of the gases. The heated gases are mixed with oxygen for complete combustion at a burner throat 92 to form a flame envelope within a boiler furnace, a kiln, or other heat exchanger apparatus. The high temperature burner forms a second stage in the combustion apparatus, which may be located adjacent the first stage apparatus or a remote distance therefrom. In applications in which the generated gas is ducted over longer distances, burners 94 (FIG. 1) are located at appropriately spaced regions in the duct to maintain a preselected minimum gas temperature to prevent condensation of the vaporized constitutents.

Optionally, a portion of the generated gas may be recirculated and mixed with the oxygen-carrying gas flowing into the first stage reaction chamber 12 from below the grate. A reciculation means 96, generally designated in FIG. 1, includes any necessary piping or control apparatus as is well known in the art. The recirculating portion provides means for increasing the water vapor content of the oxygen-carrying gas. The water vapor chemically reacts with the carbon in the fuel to provide oxygen for the sub-stoichiometeric process and increases the hydrogen content of the generated gas. Recirculation increases the BTU per cubic foot of generated gas, i.e. the potential energy content. The water vapor content of the oxygen-carrying gas may also be increased by the injection of steam or water spray into the gas.

In operation, generated combustible gas is formed from the incomplete combustion of the wood chips or other carbon-based fuel in the supplied oxygen-carrying gas. As the fuel is oxidized, material by-products such as the residual ash are periodically moved from the fuel pile. The carbon-based fuel is continually supplied to maintain a generally steady reaction in the chamber. The generated gases pass through the fuel pile and are collected thereabove. The generated gas is heated to a preselected temperature which is selected to prevent condensation of vapor constituents.

The carbon-based fuel is introduced into the reaction chamber from overhead through a plurality of inlets. Particulate matter entrainment in the generated gas is reduced by providing an excess of fuel at the fuel outlet ports so that the fuel flows slowly and smoothly in an unbroken column to the main fuel pile. Filter means may also be used to contain the dust and particulate matter that is normally stirred up at the inlet. The surface area design of the fuel pile also reduces the exit velocity of the generated gas which, in turn, limits particulate entrainment. The residual ash is removed from the chamber by a multi-layered support grate. Alternate moving layers of the grate remove the by-product material in stepwise fashion. The reaction process is monitored by sensing means and the ash removal rate is adjusted in accordance therewith. The generated gas is heated and removed to a remote location for generating useful work from the gas. The BTU content of the generated gas may be enriched through recirculation of a portion of the generated gas through the bottom of the grate assembly. The recirculation increases the moisture content of the air or oxygen-carrying gas which is fed through the bottom of the fuel pile.

The gas generating capacity of the first stage generator may be increased by increasing the longitudinal length of the reaction chamber and grate sections. Additional grate assemblies, as described sections. Additional grate assemblies, as described above, may be connected in end-to-end fashion. The length of the rectangular grate area is thereby increased.

The invention has been described with reference to a preferred embodiment. Obviously, modifications and alterations will occur to others upon reading and understanding the foregoing specification. It is my intention that the present invention be construed as including all such modifications and alterations insofar as they come within the scope of the appended claims or the equivalents thereof.

Having thus described the preferred embodiment, my invention is now claimed to be:

1. A combustion apparatus for converting carbon-based fuels into combustible gas, said apparatus comprising:

a housing which defines an internal reaction chamber;

fuel supply means for supplying fuel to said reaction chamber such that a fuel pile of generally constant configuration is maintained in the reaction chamber;

a means for supporting said fuel pile, the fuel pile supporting means being disposed adjacent a bottom of the reaction chamber and permitting the flow of gas therethrough;

a gas inlet disposed below the fuel pile supporting means for supplying an oxygen-carrying gas through the supporting means to react chemically with the fuel in the fuel pile to generate the combustible gas;

ash removal means for removing reaction by-products from adjacent the supporting means;

a gas outlet for transporting the generated combustible gas from said housing; and, means for partially combusting said generated combustible gas to inhibit condensation of the vapors from the gas.

2. The combustion apparatus as defined in claim 1 wherein the housing and the reaction chamber defined thereby are rectangular in transverse cross section.

3. The combustion apparatus as defined in claim 1 further including a combustion device operatively connected with the gas outlet for combusting the generated gas.

4. The apparatus as set forth in claim 1 further including a recirculating means for recirculating a fraction of the combustible gas from the combustible gas outlet to below the grate such that the recirculated combustible gas flows through the grate with the oxygen containing gas.

5. The apparatus as set forth in claim 1 further including a means for injecting steam or water spray into said oxygen-carrying gas to increase the moisture content of said gas.

6. The apparatus as defined in claim 1 further including a by-product removal means for removing ash from adjacent the grate with minimum disturbance to fuel oxidation, the by-product removal means removing the ash at a suitable rate.

7. The apparatus as defined in claim 6 wherein the by-product removal means includes means for reciprocating at least some of the grate sections horizontally such that ash supported on the horizontal surface of a first grate section is pushed onto the horizontal surface of a lower grate section by the vertical surface of a higher grate section, whereby ash is progressively shifted toward a lower edge of the grate for removal from the reaction chamber.

8. The combustion apparatus as defined in claim 1 wherein said fuel supply means includes a means for preventing entrainment of particulate matter into said generated gases rising from said fuel pile.

9. The combustion apparatus as defined in claim 8 wherein said entrainment preventing means includes fuel exit ports, said ports always supplied with an excess of fuel such that a continuous pile of fuel forms extending downward from said ports.

10. The combustion apparatus as defined in claim 8 wherein said entrainment preventing means includes fabric chutes through which the fuel is supplied to the fuel pile.

11. The combustion apparatus as defined in claim 1 wherein said support means includes an elongated grate having a tiered surface, said tiered surface formed of alternating fixed and movable rows of grate sections, said movable rows being movable relative to said fixed rows for pushing the by-products to progressively lower rows in stepwise fashion.

12. The combustion apparatus as defined in claim 11 wherein said rows have serpentine leading edges for increasing the contact area between said fuel and oxygen-carrying gas.

13. The combustion apparatus as defined in claim 11 further including a means for sensing the reaction, the reaction sensing means being operatively connected with means for moving the movable rows, such that the movable rows are moved in response to said sensing means sensing a preselected reaction condition.

14. The combustion apparatus as defined in claim 11 wherein said rows are serrated forming passages for said oxygen-carrying gas.

15. The combustion apparatus as defined in claim 14 wherein said rows have a continuous upper surface having no apertures therein.

16. A combustion apparatus for converting carbon-based fuels into combustible gas, said apparatus comprising;

a housing which defines an internal reaction chamber;

fuel supply means for supplying fuel to said reaction chamber, such that a fuel pile of generally constant configuration is maintained in the reaction chamber;

a means for supporting said fuel pile, the fuel pile supporting means being disposed adjacent a bottom of the reaction chamber and permitting the flow of gas therethrough, said supporting means including an elongated grate having a tiered surface, said tiered surface formed of rows of grate sections, said rows having serpentine leading edges for increasing the contact area with the fuel pile;

a gas inlet disposed below the fuel pile supporting means for supplying an oxygen-carrying gas through the supporting means for supplying an oxygen-carrying gas through the supporting means to react chemically with the fuel in the fuel pile to generate the combustible gas;

ash removal means for removing reaction by-products from adjacent the supporting means; and, a gas outlet for transporting the generated combustible gas from said housing.

* * * * *